US005190216A

United States Patent [19]

Deneke

[11] Patent Number: 5,190,216

[45] Date of Patent: Mar. 2, 1993

[54] FUEL-INJECTION APPARATUS FOR INTERNAL COMBUSTION ENGINES

[76] Inventor: Carl F. Deneke, 116 Cool Way Dr., San Antonio, Tex. 78232

[21] Appl. No.: 687,840

[22] Filed: Apr. 19, 1991

[51] Int. Cl.[5] ..... F02M 67/00

[52] U.S. Cl. ..... 239/5; 239/106; 239/434; 123/533

[58] Field of Search ..... 239/5, 93, 95, 99, 434, 239/106; 123/533, 531

[56] References Cited

U.S. PATENT DOCUMENTS

| | | | |
|---|---|---|---|
| 3,610,213 | 10/1971 | Gianini | 123/33 |
| 3,661,129 | 5/1972 | Uozumi et al. | 123/533 |
| 4,429,674 | 2/1984 | Lubbing | 123/531 |
| 4,462,760 | 7/1984 | Sarich et al. | 417/54 |
| 4,554,945 | 11/1985 | McKay | 137/312 |
| 4,592,328 | 6/1986 | Firey | 123/533 |
| 4,712,524 | 12/1987 | Smith et al. | 123/198 |
| 4,771,754 | 9/1988 | Reinke | 123/533 |
| 4,794,901 | 1/1989 | Hong et al. | 123/533 |
| 4,905,900 | 3/1990 | Scharton et al. | 239/99 |
| 5,080,060 | 1/1992 | Huang et al. | 123/533 |

FOREIGN PATENT DOCUMENTS

| | | | |
|---|---|---|---|
| 1184567 | 10/1985 | U.S.S.R. | 239/99 |
| 1202626 | 1/1986 | U.S.S.R. | 239/99 |

*Primary Examiner*—Andres Kashnikow
*Assistant Examiner*—Karen B. Merritt
*Attorney, Agent, or Firm*—Gunn, Lee & Miller

[57] ABSTRACT

A method and apparatus for delivering metered and atomized quantities of liquid to an internal combustion engine wherein the liquid is metered in a T-shaped fitting having a liquid supply arm, an air arm which is perpendicular to the supply arm, and a delivery arm is aligned with the supply arm. Liquid is pumped from a liquid source to fill the supply and part of the delivery arm of the T-shaped fitting. A predetermined pulse of pressurized air is delivered to the air arm of the T-shaped fitting, transversely striking and severing the accumulated liquid in the delivery arm from the liquid in the supply arm to form a liquid slug. The pressurized air pulse forces the liquid slug out of the T-shaped fitting into an acceleration pipe, accelerates the liquid slug through the acceleration pipe, stores kinetic energy in the moving liquid slug, moves the liquid slug through a nozzle, atomizes the liquid slug, and cleans the nozzle and preconnected passages of residual liquid. The quantity of liquid atomized is controlled by regulating the amount of liquid delivered to the supply arm and the timing of the atomization is controlled by timing the delivery of the pressurized air pulse to the air arm.

9 Claims, 4 Drawing Sheets

FUEL-INJECTION APPARATUS FOR INTERNAL COMBUSTION ENGINES

BACKGROUND OF THE INVENTION

1. Field of the Invention

Applicant's invention relates to an apparatus and method for metering and atomizing liquids in small quantities and at high rates. This invention is particularly applicable to the metering and delivery of fuel to an internal combustion engine, however, it is readily appreciated that there are other applications in which the metering and atomization of a liquid is desired.

2. Summary of Prior Art

The delivery of fuel to internal combustion engines has historically been accomplished by carburetors. The wick carburetor and the surface carburetor were used between 1848 and 1900. These devices use the evaporation of liquid fuel to form the combustible mixture.

Except for these early attempts, engine fuel has been mechanically dispersed using either jets located in a venturi tube, such as in a carburetor or by forcing the fuel through a nozzle as in a fuel injector.

In an engine, the fuel must be sufficiently atomized so that the fuel will burn in a relatively short period of time. In an Otto cycle engine, combustion of the fuel and air begins slightly before the piston reaches top dead center (TDC), continues throughout much of the power stroke, and should optimally be completed before the piston reaches the bottom of its stroke because only during the expansion of the burning gas is energy transferred to the piston.

A typical carburetor provides a degree of self-regulation of the air-fuel ratio. As the throttle is opened, more air is passed through the intake manifold, through the venturi, and then through the engine's combustion chamber. As more air is admitted, the velocity of the air through the carburetor venturi increases which, in turn, decreases the air pressure at the carburetor jets. This decreased pressure pulls fuel from the jets into the air stream. The amount of fuel expelled is determined by the difference in pressure between the fuel at the carburetor jets in the venturi and atmospheric pressure.

The optimal combustion of fuel in an internal combustion engine involves several factors. First, the proper ratios of fuel and air are necessary to prevent damage to the engine and to minimize exhaust emissions. For a gasoline burning internal combustion engine the stoichiometric ratio is 14.7 times as much air as gasoline by weight.

A second factor is the load on the engine. For light load, part throttle operation, an air:fuel ratio as low as 16.1:1 would be adequate, but for a full load such as full throttle acceleration, an air:fuel ratio of 12:1 may be required. Other factors to be considered when determining the proper air:fuel ratio include: engine speed, ambient and engine temperature, and the specific density of the fuel.

A typical carburetor provides a relatively good degree of self-regulation over the air and fuel mixture because of the inherent design. The float maintains a constant head of fuel relative to the carburetor jets. As fuel is consumed, the fuel level in the float chamber drops which causes the float to pivot downward on the float arm which pulls the needle valve from its seat. This allows more fuel to fill the float chamber or float bowl. The carburetor jets are located in the venturi and are fed with fuel from the float chamber. The float bowl is vented to the atmosphere so the total differential pressure across the jets is proportional to the height of the fuel above the jets plus the differential pressure between atmospheric and the manifold pressure at the jets. Manifold pressure at the jets is a function of manifold pressure and the velocity of the air through the venturi. Thus, as the throttle is opened the air flow increases, the air pressure in the venturi drops, and more fuel is pulled from the float bowl into the air stream.

The carburetor's simple design and ability to provide an air:fuel fixture within 5% of the ideal mixture made the carburetor the accepted fuel delivery and mixing device in the early evolution of internal combustion engines. However, current demands on internal combustion engines of fuel economy and minimized exhaust emissions demand more than the approximation of the proper air:fuel mixture.

Automotive internal combustion engines now use engine control computers to measure the intake air temperature, coolant temperature, air pressure, engine speed and load, and throttle position. The control computer can then calculate the correct air:fuel mixture and adjust the fuel delivery system appropriately.

Fuel injection was developed as an alternate mechanical system used to mix and to deliver fuel and air to internal combustion engines. Fuel injection was first widely applied to the diesel engines where the carburetor did not furnish sufficient atomization of the fuel. Diesel fuel is heavier and less volatile than gasoline, thus very high pressure was needed to properly atomize and meter the fuel.

The first automobile gasoline fuel injectors were direct, mechanical fuel injectors developed by Bosch and Mercedes-Benz in the early 1950's. These fuel injectors pumped the fuel either directly into the cylinder or into the intake manifold. High pressure injection pumps, directly driven from the engine, discharged fuel through rigid tubing to the nozzle. The nozzle discharge pressures were about 1500 psi to properly atomize the fuel. The fuel pressure overcame a spring loaded valve in the injector body which eliminated the need for a return fuel line.

In the late 1950's Mercedes-Benz began the development of port injection which could use lower fuel pressures, as the injection did not have to overcome combustion chamber pressures. This was first used in the 1957 Mercedes-Benz 300d and port-type injectors have been universal since then.

A common problem in pulsed or intermittent fuel injectors is that the fuel may "blob" on the nozzle rather than being atomized. This is generally caused by either a slow pressure rise or the loss of pressure in the fuel lines between the nozzle, and the liquid forms a "blob" or drop on the intake manifold side of the injector. This excess fuel is then carried into the combustion chamber as a drop too large to undergo complete combustion under the constraints of engine operating conditions. Incomplete combustion will contribute both to wasted fuel and to increased emissions.

An early electronic fuel injection system, is known wherein a pressurized fuel supply (typically 20 to 100 psi) is delivered to each injector from a fuel pump, which supplies the mechanical energy required for atomization, stored as compression of the fuel. The injector body contains a solenoid, which, when energized, allows fuel to pass into the nozzle. Although this design has been improved, particularly the controlling electronics, the basic operation has stayed the same.

Gianini in U.S. Pat. No. 3,610,213 designed a fuel injector trying to minimize inconsistent air:fuel ratios, pulsations caused by the high frequency of breaks in the fuel stream (caused by the cycling of the injectors), and improper fuel storage in the intake manifold. Gianini's invention consists of a fuel injection system having a separate fuel source, an injector having a fuel reservoir of a size at least as great as the volume of fuel to be injected into the cylinder, a mechanical pump to supply fuel from the fuel source to the injector reservoir, an air source, and a separate pump to supply the air to the injector to atomize the fuel in the reservoir.

U.S. Pat. No. 4,429,674 issued to Lubbing teaches a multi-cylinder internal combustion engine having a fuel source, an air source, premixing of the fuel and air in the injection nozzle, a discharge orifice continuously discharging the premixed air and fuel to a common fuel supply chamber, and a separate air intake system using air to supply the premixed air and fuel to the engine cylinders. The use of air is primarily for transporting the premixed air and fuel mixture. The air does not assist in the generation or metering of the air-fuel mixture for combustion. The initial fuel-air mixture is generated using the current technology, that is a conventional nozzle.

Another fuel injector design is disclosed by Sarich in U.S. Pat. No. 4,462,776. Sarich teaches a method and apparatus for delivering metered quantities of liquid wherein the liquid is circulated through a metering chamber, filling the chamber with the liquid, closing the liquid circulation ports when the metering chamber is full, opening a gas inlet port and a discharge port, and admitting gas under pressure through the gas inlet port into the metering chamber and expelling the liquid from the metering chamber through the discharge port. Once the liquid is expelled, the gas inlet port and the discharge port are closed and the fuel is again circulated through the metering chamber. The amount of liquid in the metering chamber can be regulated only by moving the gas inlet port mechanism so as to define a larger or smaller cavity.

A fuel injection system with a leakage collection is disclosed in McKay, U.S. Pat. No. 4,554,945. McKay consists of a metering chamber, a gas supply chamber, a metering member, and a leakage collection chamber. The metering member movable extends into the metering chamber to meter the fuel. Gas carried by the metering member displaces the fuel in the metering chamber. Any gas or fuel leakage collects in the leakage collection chamber and is returned to its appropriate chamber.

An attempt to minimize cycle to cycle variation in fuel delivery caused by the build up of residual fuel is disclosed by Smith, U.S. Pat. No. 4,712,524. Smith believes that average thickness of the residual fuel film on the wall of the fuel delivery tube between the metering device and the engine increases as the metered quantity of fuel per delivery increases, when a fixed amount of air is used to convey the fuel through the delivery tube. To resolve this problem, Smith teaches a method of delivering fuel to an internal combustion engine comprising the delivering of individual metered quantities of fuel into a conduit by an individual air pulse, and establishing a secondary gas flow in the conduit to sweep the conduit clean. The secondary gas flow would only occur for part of the time interval between respective air pulses to deliver the metered quantities of fuel along the conduit. The individual air pulses do not meter the fuel as the metering of the fuel is accomplished using standard metering devices.

Electronic fuel injectors are replacing entirely mechanical injectors because electronic fuel injectors allow greater monitoring of relevant factors and subsequent metering of the fuel and air mixture for combustion. Development of the electronic fuel injectors has concentrated primarily on the electronics associated with the electronic fuel injectors allowing monitoring of numerous conditions such as: intake air mass, air pressure, air temperature, coolant temperature, oil temperature, engine load, throttle position, crankshaft position, engine revolutions per minute, and exhaust gas composition. Complete computerization of the fuel injection and spark ignition have led to greater fuel efficiency, power, and reduced emissions.

The current fuel injection systems suffer from several problems, namely they are complex, fragile, and require excessive maintenance than is desirable. Fuel metering is generally accomplished by metering chambers, requiring complex apparatus to vary the volume of the charge of fuel. Therefore, a practical and economical solution is needed for these problems.

SUMMARY OF THE INVENTION

A method and apparatus for delivering metered and, if desired, atomized quantities of liquid, wherein the liquid is metered in a T-shaped fitting having a liquid supply arm, an air arm which is perpendicular to the liquid supply arm, and a delivery arm which is aligned with the liquid supply arm. Liquid is pumped through a liquid supply pipe to fill the supply arm and part of the delivery arm of the T-shaped fitting. A predetermined amount of pressurized air is delivered by an air supply pump to the air arm of the T-shaped fitting, transvesely striking and severing the accumulated liquid in the delivery arm from that in the supply arm, forming a liquid slug. The pressurized air pulse forces the liquid slug through an acceleration conduit and stores kinetic energy in the moving liquid slug. If atomization is desired, the liquid slug is forced through an atomizing nozzle by the pressurized air pulse and atomized. The pressurized air pulse also cleans residual liquid from the delivery arm, the acceleration conduit and the nozzle. The quantity of liquid atomized is controlled by regulating the amount of liquid delivered to the delivery arm and by regulating the timing of delivery of the pressurized air pulse to the air arm.

It is an object of the present invention to provide an efficient method and apparatus for the metering and, if desired, atomizing of liquid which is inexpensive to build and maintain and which can be used for a wide range of liquids.

It is another object of the present invention to provide more consistent metering of liquid fuel into successive slugs of preselected volumes.

The foregoing objectives are achieved in applicant's invention by using pressurized air pulses to meter, atomize fuel, and deliver the fuel to an internal combustion engine. Applicant's invention also permits its practitioner to expand the use of the vehicle's computer system to control all aspects of fuel injection and combustion, including timing the fuel injection which allows faster and more efficient delivery and atomization of fuel.

DETAILED DESCRIPTION OF THE PREFERRED EMBODIMENT

Figure 1:
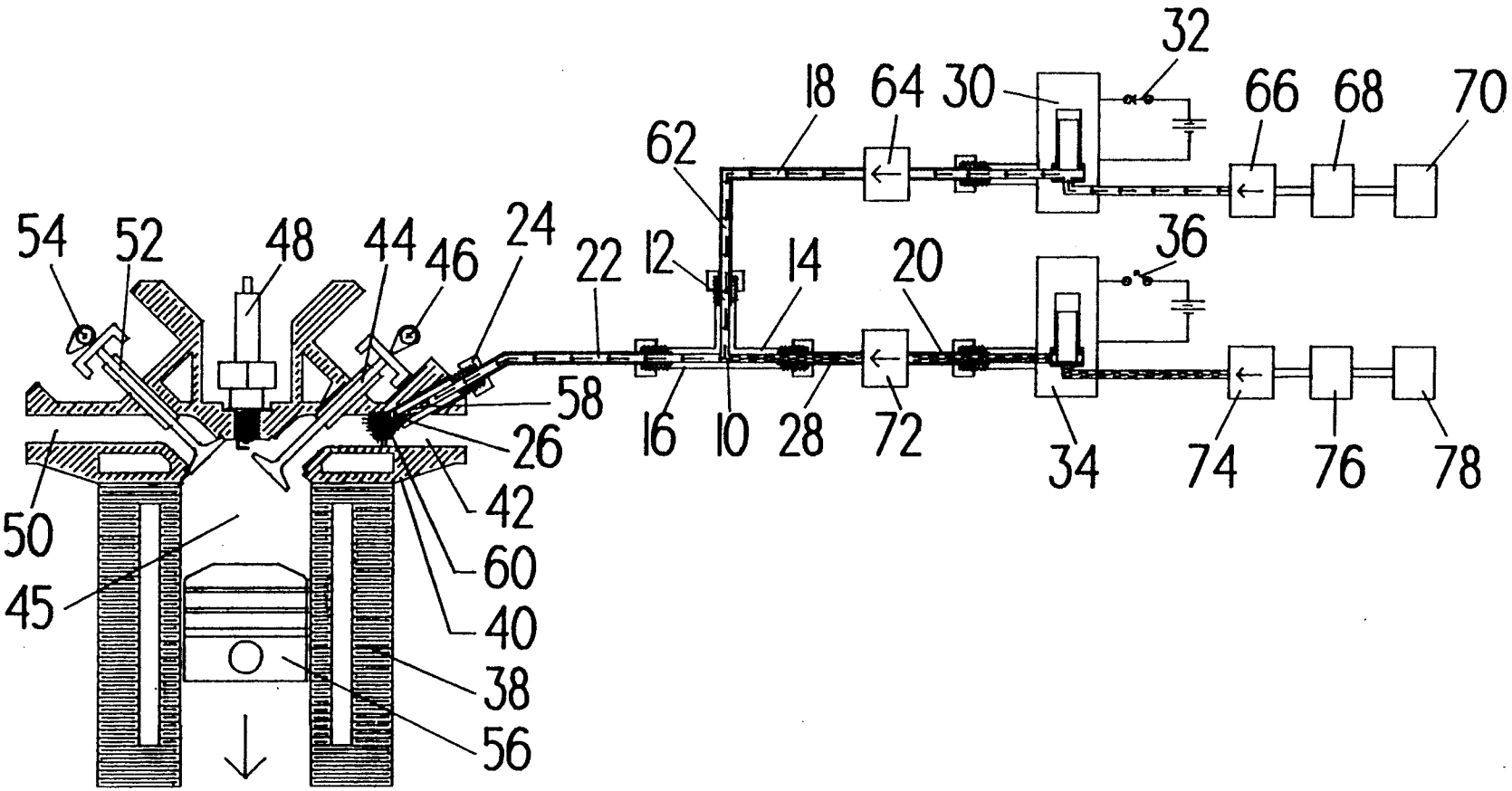
FIG. 1 is a schematic cross sectional view of a preferred embodiment of a method and apparatus for metering and atomizing a liquid fuel constructed in accordance with this disclosure.

One application of the method and apparatus of this invention for metering and atomizing a liquid is shown in FIG. 1 as it would be used to meter and atomize fuel for an internal combustion engine, however, the invention can be used in any application where time spaced metering of a liquid into discrete slugs may be needed.

With reference to FIG. 1, the T-shaped fitting (10) has an air arm (12) perpendicular to a liquid fuel supply arm (14) and a delivery arm (16). Pressurized pulses of air (62) travel through air pipe (18) from air solenoid pump (30). The production of successive pulses of pressurized air is controlled through an air control switch (32). Air at a lower pressure is supplied to the inlet of solenoid pump from a pump (70) and passes through an air pulse damper (68) and a one way or check valve (66).

Fuel supply pipe (20) carries the liquid fuel (28) from fuel solenoid pump (34), which is controlled by the fuel control switch (36) into fitting (10) and partly into delivery arm (16). Liquid fuel is supplied to the inlet of solenoid pump (30) by a fuel pump (78) and passes through a fuel pulse damper (76) and a one way or check valve (74). The transverse flow of the pressurized air pulse severs the liquid column to produce a fuel slug (58). Fuel slug (58) is accelerated through the acceleration pipe (22) by the air pressure pulse until the fuel slug reaches the nozzle assembly (24). The pressurized air pulse (62) forces the fuel slug through the nozzle orifice (26) at which time the fuel slug (58) becomes vaporized into an atomized mist (60).

The atomized mist (60) is shown entering a standard internal combustion engine having engine block (38) and a cylinder head (40). The atomized mist (60) is sprayed into the intake port (42) with the intake cam (46) holding intake valve (44) in the open position. While the intake valve (44) is open, pressurized air (62) flows through the nozzle assembly (24), cleaning the acceleration pipe (22) and nozzle orifice (26), and into the combustion chamber (45) where it is mixed with air supplied through intake port (42). The air pressure pulse is then terminated by air valve switch (32). As the intake cam (46) rotates to allow the intake valve (44) to close, the piston (56) moves upward compressing the atomized fuel and air. The spark plug (48) ignites the mixture. Once ignition has occurred, the rotating exhaust cam (54) opens the exhaust valve (52) to allow the combustion gases to escape out the exhaust port (50).

Figure 2:
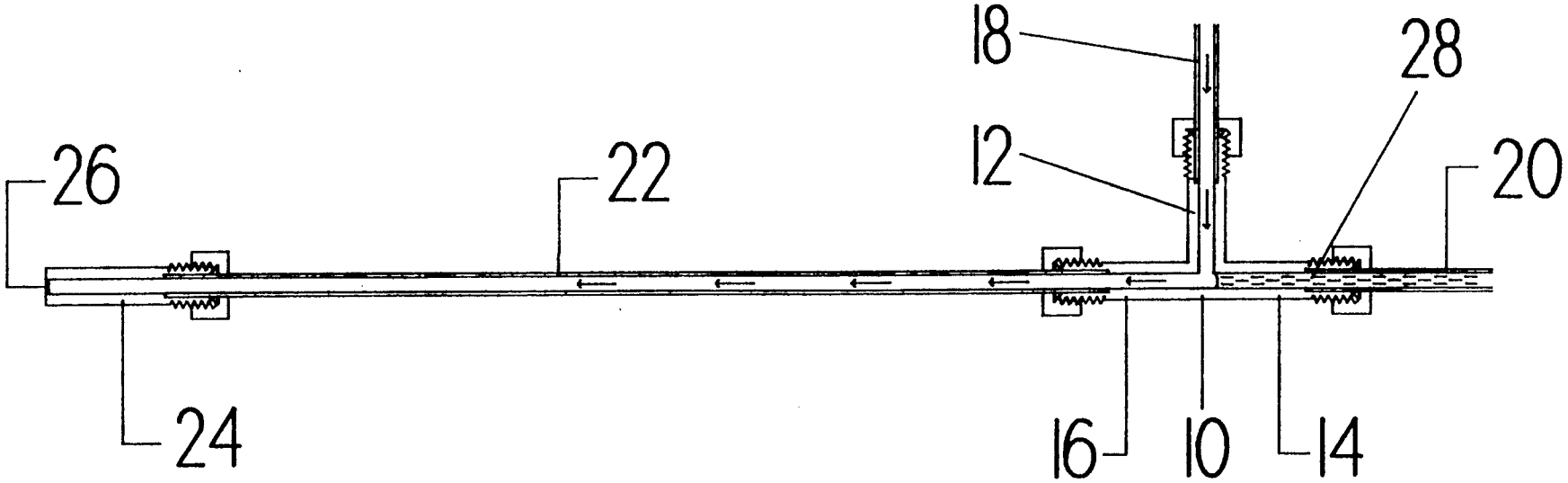
FIG. 2 is a partial view of FIG. 1 illustrating the method and apparatus of the present invention at the pre-injection phase.

With reference to FIG. 2, the preferred embodiment of the present invention is illustrated in more detail at the pre-injection phase wherein a column of liquid fuel (28) is moved into the supply arm (14) and partly into the delivery arm (16) of the T-shaped fitting (10) by liquid pump (34). A pre-determined amount of fuel (28) is thus delivered into delivery arm (16) of the T-shaped fitting (10). This process is accomplished by any generally accepted pump and valve system. However, in the preferred embodiment, a solenoid valve (34) shown in FIG. 1 is used because of is ability to be easily controlled by a computer resulting in adjustability to varied operating conditions. The fuel flow process may be a low precise process, taking as long as 1.5 engine revolutions.

Because the fuel flow is a much slower process in this design, as compared to the current fuel injector designs, the inertia of the fuel mass has less effect on the atomization of the fuel during the fuel metering phase. During the actual injection phase, this invention does not move the mass of the fuel contained in the fuel lines from the fuel pump to the T-fitting (10). That is, considering a conventional injector, the entire mass of fuel from the fuel pump (which supplies the energy) to the injection nozzle must be moved during the injection period. The injection period may be on the order of 90 degrees of crankshaft revolution. In the invention disclosed here, the main mass of fuel is moved over at least 540 degrees of crankshaft revolution, while only the small volume or slug to be injected is moved over the 90 degrees of crankshaft revolution.

Figure 3A:
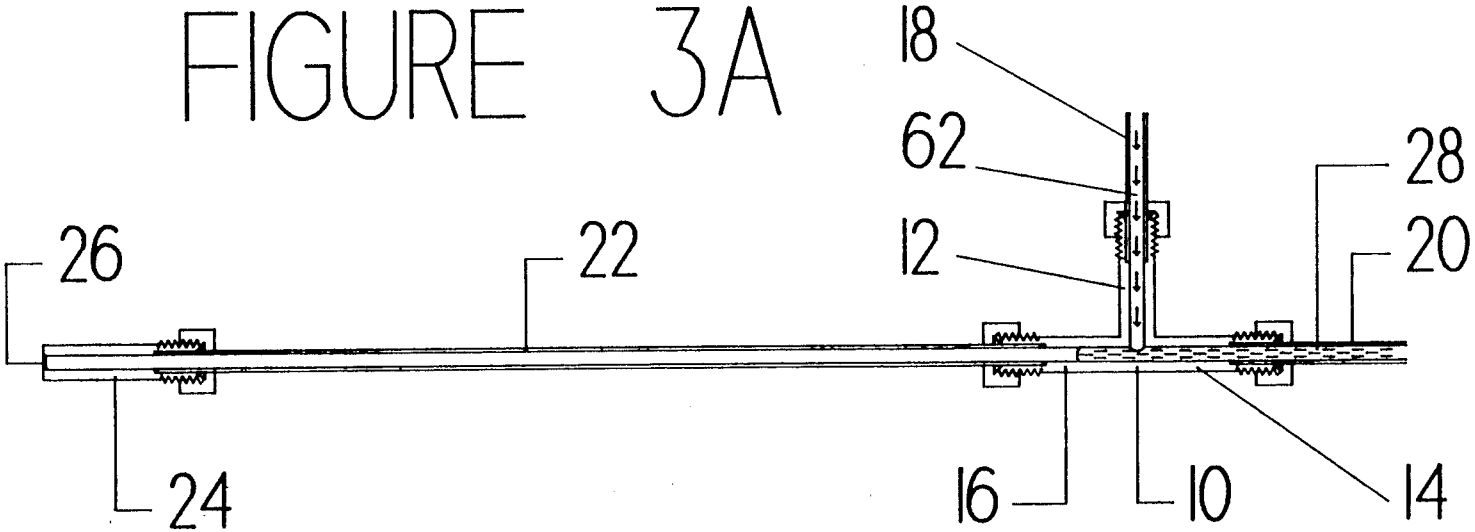
FIG. 3A and FIG. 3B are cross sectional views similar to FIG. 2 respectively illustrating liquid entering the metering fitting and the subsequent creation of the liquid slug.

After the desired amount of fuel has passed through the fuel supply arm (14) and into the T-fitting (10), as shown in FIG. 3A, partly filling the intake portion of the fuel delivery arm (16), the fuel supply solenoid pump (34) stops.

The amount of liquid fuel in the delivery arm (16) can vary depending upon the needs of the engine. The fuel is now ready to be injected by the pneumatic process. A pulse of pressurized air (62) travels through air pipe (18) into the air arm (12) of the T-shaped fitting (10) perpendicularly intersecting the liquid column in supply arm (14) and delivery arm (16) of the T-shaped fitting (10). The energy required to meter and atomize the fuel is provided by a lower pressure air supply (generally less than 50 psi).

Figure 3B:
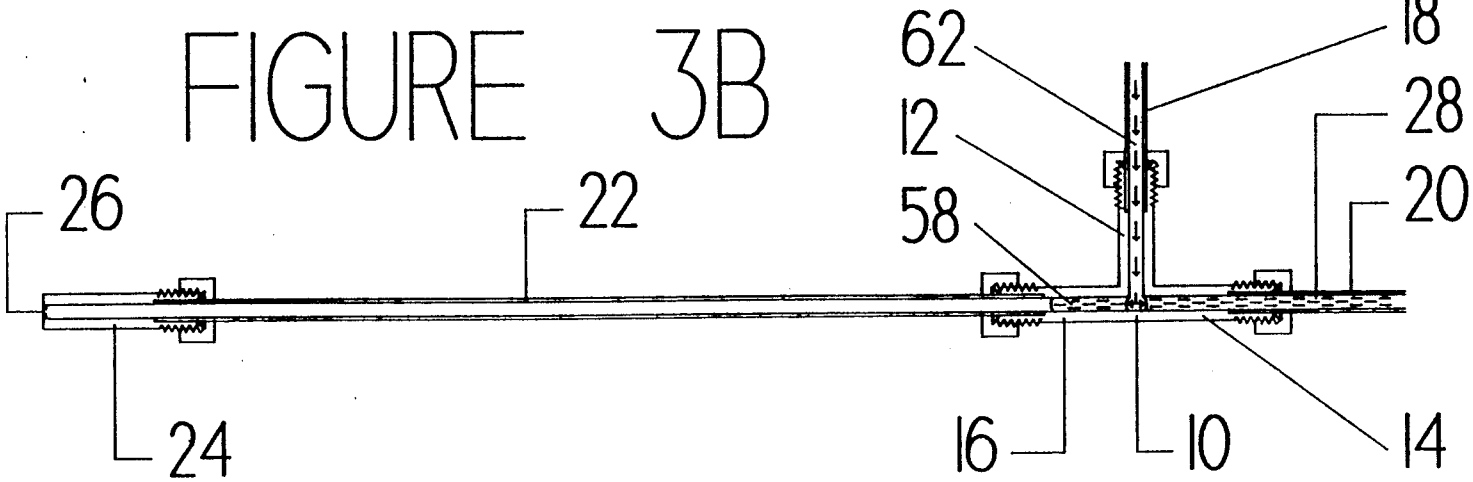

As shown in FIG. 3B, the force of the pressurized air (62) transversely striking the fuel (28) results in a severing of that portion of fuel (28) located between the delivery arm (16) of T-shaped fitting (10) and the intersection of the air arm (12). Two effects of the pressurized air (62) striking the fuel (28) occur. First, a fuel slug (58) is formed from the severed portion of fuel (28) located in the delivery arm (16) of the T-shaped fitting (10). Second, as the pressurized air (62) pushes completely through the fuel (28), separating the fuel slug (58), the pressurized air will act to hold the remaining fuel (28) within the delivery arm (14) of the T-shaped fitting (10). The fuel slug (58) is now positioned to leave the delivery arm (16) of T-shaped fitting (10) and enter an acceleration injection pipe (22), which is an extension of delivery arm (16).

Figure 4A:
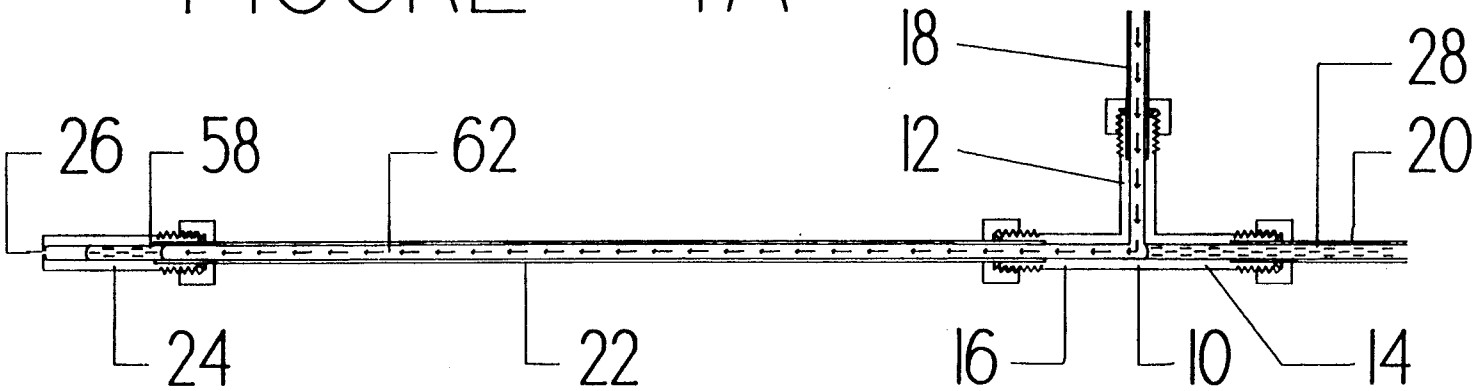
FIG. 4A and FIG. 4B are cross sectional views similar to FIG. 2 respectively illustrating the acceleration and atomization of the liquid slug.

Turning to FIG. 4A, the fuel slug (58) is accelerated through the acceleration injection pipe (22) by the pressurized air pulse (62), and kinetic energy is stored in the fuel slug (58) at a constant rate. The kinetic energy will be used in atomization of the fuel slug (58).

Figure 4B:
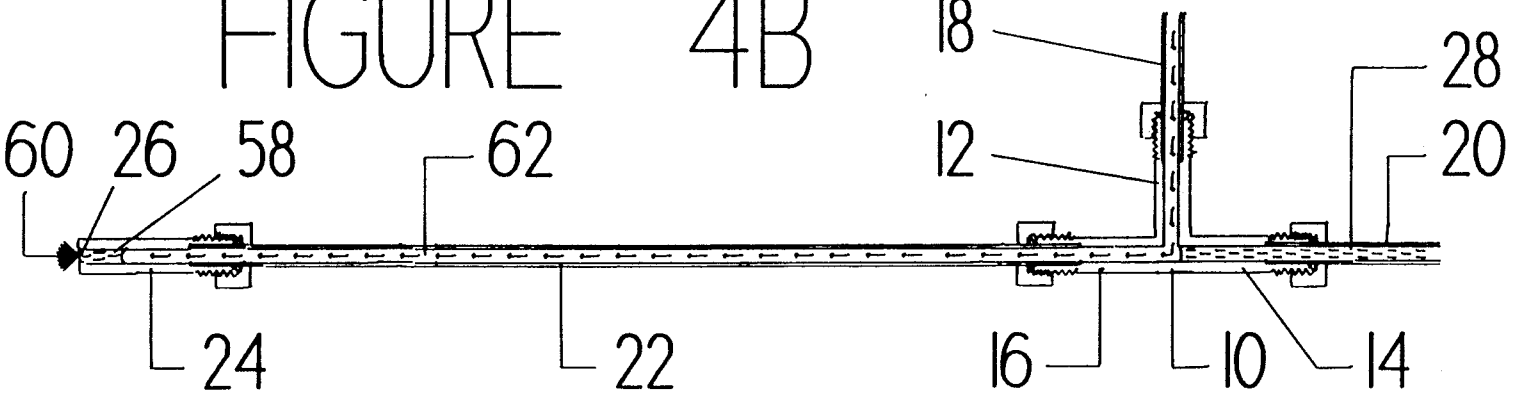

FIG. 4A shows the accelerated fuel slug (58) entering the nozzle assembly (24). FIG. 4B shows the fuel slug (58) impacting the nozzle orifice (26). As the fuel slug

(58) impacts the nozzle orifice (26), pressurized air (62) forces the fuel through the nozzle orifice (26) vaporizing the fuel slug (58) into a fine mist of atomized fuel (60). Even after air valve switch (32) of FIG. 1 stops air pump (30) of FIG. 1, the pressurized air (62) trailing the accelerated fuel slug (58) cannot be injected into the intake manifold until all of the fuel slug (58) has been forced through nozzle orifice (26). The final pressurized air (62) passing through the nozzle orifice (26) will clean the nozzle orifice (26), the acceleration conduit (22) and the delivery arm (16) of any residual fuel.

Until atomization and injection is completed, the air pressure is constantly pushing the fuel so that there is less "blobbing" on the injector nozzle at the end of the injection cycle. The nozzle and the preceding piping are blown clean with each injection.

In certain situations, the arrangement of the T-shaped fitting (10) may be varied. For example, the air arm (12) may be switched with the supply arm (14) so that the supply arm (14) is perpendicular to both the air arm (12) and the delivery arm (16).

To improve the consistency of the volume of the successive slugs of liquid generated by the method and apparatus of this invention, it is desirable to incorporate check valves at various points in the flow passages, such as check valves (66) and (74). Additionally, a check valve (64) may be incorporated adjacent the input end of the gas arm (12) with the liquid supply arm (14). Check valve (64) permits only uni-directional flow of the compressed air pulses and thus prevents any significant quantity of liquid from entering the air arm (12).

A check valve (72) may be incorporated in the conduit (20) connected to the supply arm (14) of the fitting (10) to prevent reverse flow of liquid due to the higher pressure of the air pulse supplied through the air arm (12). Thus the column of liquid disposed in the air arm (14) will not be substantially displaced rearwardly beyond the juncture of the air arm (12) herewith.

From the foregoing description, it will be apparent that this invention contemplates the provision of means defining a first flow path (14) which is in fluid communication with a supply pump; means defining a second flow path (12) transversely intersecting the first flow path and connected to a source of time spaced pulses of pressurized gas; and means defining a third flow path (16) extending from the intersection of the first and second flow paths to a delivery conduit for slugs of liquid.

Each pulse of pressurized gas supplied through the second flow path (12) effects severing of the column of liquid disposed in the first flow path (14) and partly in the third flow path (16), thus isolating a slug (58) of liquid. The liquid slug is accelerated by the pressurized gas pulse through a communicating acceleration pipe (22) and is then directed into a nozzle (26) for atomization by the pressured gas pulse, if atomization is desired. Suitable pumps (78) and (70) are respectively provided for supplying the liquid fuel to the liquid supply first flow path through check valve (74), and the compressed gas pulses, which is normally air, to the second flow path through check valve (66). Such pumps are preferably of the solenoid type and are electrically actuated by a computer system which measures the atomized requirements of the consuming apparatus and determines the duration and magnitude of the pressured gas pulse and the rate of flow of the liquid through the liquid supply first flow patch.

The air metering system of applicant's invention has at least four advantages. First, it is cheaper. There is less machining and less precision manufacture required. Secondly, it is easily computer controlled, which extends the ability of onboard computers to complete fuel system management. This would include such system parameters as amount of fuel injected and injection time. This allows designers to allow the engine to control its own mixture, depending on the oxygen sensor in the exhaust manifold and other sensors, so that the engine could self-adjust to fuels with varying oxygen content (i.e., alcohol blends) or even to gases such as propane. Thirdly, the simplicity of the metering apparatus does not require elaborate seals so that this design is fundamentally able to tolerate a wide variety of liquids. Thus, the designer is freed from the necessity of proscribing the use of high alcohol fuels. Lastly, the metering and delivery of successive slugs of liquid is highly accurate and consistent.

Although the invention has been described with reference to a specific application, this description is not meant to be construed in a limited sense. Various modifications of the disclosed embodiment, as well as alternative embodiments of the invention, will become apparent to persons skilled in the art upon the reference to the description of the invention. It is, therefore, contemplated that the appended claims will cover such modifications that fall within the scope of the invention.

What is claimed and desired to be secured by Letters Patent is:

1. In combination with an internal combustion engine having a combustion chamber, a fuel inlet passage communicating with said combustion chamber, and a fuel inlet valve for intermittently opening and closing said fuel inlet passage, apparatus for intermittently discharging a slug of airborne, atomized fuel into said fuel inlet passage whenever said fuel inlet valve is open, comprising:

a source of liquid fuel;

means defining a first flow path extending to said fuel inlet valve;

an intermittently operable liquid pump means connected between said source of liquid fuel and said first flow path means and operable to intermittently force a column of liquid fuel into an input portion of said first flow path means when said fuel inlet valve is closed;

a source of pressurized air;

means defining a second flow path intersecting and terminating said input portion of said first flow path means;

an intermittently operable gas pump means connected between said source of pressurized air and said second flow path means;

means for timing the intermittent operation of said fuel inlet valve, said liquid pump means and said gas pump means to produce a pulsed flow of air through said second flow path means at a pressure sufficient to sever said column of liquid fuel at said intersection of said first and second flow path means and acceleratingly advance said severed portion of said liquid fuel column through said first flow path means toward said opened fuel inlet valve; and means in an output end of said first flow path means for atomizing said severed portion of said liquid fuel column to supply said fuel inlet passage with consistent volume pulses of an air and atomized fuel mixture.

2. The apparatus of claim 1 wherein both said intermittently operable liquid and gas pump means comprise electrically actuated solenoid pumps.

3. The apparatus of claim 1 further comprising first check valve means for preventing reverse liquid fuel flow in said first flow path means.

4. The apparatus of claim 3 further comprising second check valve means for preventing liquid fuel flow into said second flow path means.

5. The apparatus of claims 1, 2, 3 or 4 further comprising means for varying the liquid fuel pressure output of said liquid pump means, whereby the volume of said severed portion of said liquid fuel column may be selectively varied.

6. The apparatus of claims 1, 2, 3 or 4 wherein said intermittently operable gas pump means is timed to maintain a gas pressure in said first flow path means until all of said severed portion of said liquid fuel column has been discharged through said atomizing means, thereby purging the output end of said first flow path means and said atomizing means of liquid fuel.

7. The method of producing and delivering consecutive charges of a consistent volume mixture of air and an atomized liquid fuel to the combustion chamber of an internal combustion engine through a fuel inlet valve, comprising the steps of:

(1) supplying pressured liquid fuel to an input end of a delivery conduit extending to said fuel inlet valve of said combustion chamber at a preselected pressure to form a column of liquid fuel only in said input end when said fuel inlet valve is closed;

(2) supplying a pulse of pressurized air transversely into said input end of the delivery conduit, the pressure of said air substantially exceeding the pressure of said liquid fuel, thereby severing a slug of liquid fuel from said liquid fuel column;

(3) opening said fuel inlet valve;

(4) propelling said slug of liquid fuel by said air pressure along said delivery conduit with an increasing velocity; and (5) passing said accelerated slug of liquid fuel and said pulse of air through an atomizing nozzle to produce a charge of air and atomized fuel for entry into said combustion chamber through said opened fuel inlet valve.

8. The method of claim 7 further comprising the step of varying the pressure of said liquid fuel to vary the volume of said liquid fuel slug.

9. The method of claim 7 further comprising the step of maintaining said pulse of pressurized air until an output end of said delivery conduit and said atomizing nozzle are purged of liquid fuel.

* * * * *